US006854872B2

(12) United States Patent
Davenport

(10) Patent No.: US 6,854,872 B2
(45) Date of Patent: Feb. 15, 2005

(54) OPTICALLY ETCHED DECORATIVE ARTICLE

(76) Inventor: Ben Davenport, 1703 Whitehall Dr. #8H, Longmont, CO (US) 80501

( * ) Notice: Subject to any disclaimer, the term of this patent is extended or adjusted under 35 U.S.C. 154(b) by 159 days.

(21) Appl. No.: 10/347,002

(22) Filed: Jan. 17, 2003

(65) Prior Publication Data

US 2004/0141325 A1 Jul. 22, 2004

(51) Int. Cl.[7] ..... F21S 4/00

(52) U.S. Cl. ..... 362/806; 362/812; 362/565; 40/800

(58) Field of Search ..... 362/565, 808, 362/809, 812, 326, 327, 329, 351, 363; 40/800, 538, 358; 428/13, 29

(56) References Cited

U.S. PATENT DOCUMENTS 4,347,270 A * 8/1982 Hart ..... 428/13
4,715,137 A * 12/1987 Scheve ..... 40/546
5,407,711 A * 4/1995 Lovison et al. ..... 428/13
6,481,131 B2 * 11/2002 Gianotti et al. ..... 40/546
2003/0079387 A1 * 5/2003 Derose ..... 40/544

* cited by examiner

*Primary Examiner*—Thomas M. Sember
*Assistant Examiner*—Hargobind S. Sawhney
(74) *Attorney, Agent, or Firm*—Scott L. Terrell

(57) ABSTRACT

A decorative article is provided having an optically transparent solid material, having top, bottom, front, back and side surfaces, an opaque material covering the back, side and top surfaces, and an image inside the transparent material defined by etch points having a convex exterior surface facing the back surface and a concave interior surface facing the front surface.

8 Claims, 3 Drawing Sheets

OPTICALLY ETCHED DECORATIVE ARTICLE

CROSS REFERENCE TO RELATED APPLICATIONS

None.

BACKGROUND OF THE INVENTION

1. Field of the Invention

The present invention relates to optically etched decorative articles. In particular, it relates to a three dimensional optically etched image inside a transparent material which appears to move within the transparent material when viewed at different angles.

2. Description of the Related Art

Images, such as a portrait, design, or logo may be optically etched in transparent materials. A number of techniques for creating a variety of patterns on the surface and inside of transparent substrates using pulsed laser radiation are well known.

For example, U.S. Pat. No. 6,087,617, to Deal, discloses a computer graphics system for generating an image reproducible in the interior of optically transparent material. The image reproducible inside optically transparent material is defined by potential etch points, in which the breakdowns required to create the image in the select optically transparent material are possible. The potential etch points are generated based on the characteristics of the selected optically transparent material.

One publication disclosing such techniques is the Russian invention #321422 to Agadjanov et. al., published on Nov. 16, 1970 (#140454529-33). The invention concerns a method of manufacturing decorative products inside a transparent material by changing the material structure by laser radiation. As disclosed, by moving a material relative to a focused laser beam, it is possible to create a drawing inside the material.

U.S. Pat. No. 4,092,518 to Merard discloses a method for decorating transparent plastic articles. This technique is carried out by directing a pulsed laser beam into the body of an article by successively focusing the laser beam in different regions within the body of the article. The effect of the laser is a number of three dimensional "macro-destruction" (fissures in the material of the article) appearing as fanned-out cracks. The pattern of the cracks produced in the article is controlled by changing the depth of the laser beam focus along the length of the article.

U.S. Pat. No. 5,206,496 to Clement et al. discloses a method and apparatus for providing in a transparent material, such as glass or plastic, a mark which is visible to the naked eye or which may be "seen" by optical instruments operating at an appropriate wavelength. The Clement et al. Patent describes a method and apparatus for producing a subsurface marking which is produced in a body, by directing into the body a high energy density beam and bringing the beam to focus at a location spaced from the surface, so as to cause localized ionization of the material. In the preferred embodiment the apparatus includes a laser as the high energy density beam source. The laser may be a Nd-YAG laser that emits a pulsed beam of laser radiation with a wavelength of 1064 nm.

Soviet patent publication 1838163 to P. V. Agrynsky, et. al discloses a process for forming an image in a solid media by processing of the optically transparent solid material by a beam of radiation with changeable energy for creation of the image.

WIPO Patent Document No. 96/30219 to Lebedev et al. discloses a technology for creating two- or three-dimensional images inside a polymer material using penetrating electromagnetic radiation. The technology can be used for marking and for producing decorative articles and souvenirs. Specifically, laser radiation is used as the penetrating radiation, and carbonizing polymers are used as the polymer material. By these means, it is possible to produce both black and half-tone images in the articles.

U.S. Pat. No. 5,575,936 to Goldfarb discloses a process and apparatus where a focused laser beam causes local destruction within a solid article, without effecting the surface thereof The apparatus for etching an image within a solid article includes a laser focused to a focal point within the article. The position of the article with respect to the focal point is varied. Control means, coupled to the laser, and positioning means are provided for firing the laser so that a local disruption occurs within the article to form the image within the article.

U.S. Pat. No. 5,637,244 to Erokhin discloses a technique which depends on a particular optical system including a diffraction limited Q-switched laser (preferably a solid-state single-mode TEM.sub.00) aimed into a defocusing lens having a variable focal length to control the light impinging on a subsequent focusing lens that refocuses the laser beam onto the transparent article being etched. The laser power level, operation of the defocusing lens, and the movement of the transparent article being etched are all controlled by a computer. The computer operates to reproduce a pre- programmed three-dimensional image inside the transparent article being etched. In the computer memory, the image is presented as arrays of picture elements on various parallel planes. The optical system is controlled to reproduce the stored arrays of picture elements inside the transparent material. A method for forming a predetermined half-tone image is disclosed. Accordance to the method, microdestructions of a first size are created to form a first portion of the image and microdestruction of a second size different from the first size are created to form a second portion of the image. Different sizes of microdestructions are created by changing the laser beam focusing sharpness and the radiation power thereof before each shot.

U.S. Pat. No. 5,886,318 to A. Vasiliev and B. Goldfarb discloses a method for laser-assisted image formation in transparent specimens, which consists in establishing a laser beam having different angular divergence values in two mutually square planes.

EPO Patent Document 0743128 to Balickas et al. discloses a method of marking products made of transparent materials which involves concentration of a laser beam in the material which does not absorb the beam, at a predetermined location, destruction of the material by laser pulses and formation of the marking symbol by displacement of the laser beam. Destruction of the material at that location takes place in two stages. In the first stage, the resistance of the material to laser radiation is altered, while, in the second stage, destruction of the material takes place at that location.

U.S. patent application Ser. No. 08/643,918 to Troitski et al. discloses a computer graphic system for producing an image inside optically transparent material. An image reproducible inside optically transparent material by the system is defined by potential etch points, in which the breakdowns required to create the image in the selected optically transparent material are possible. The potential etch points are generated based on the characteristics of the selected optically transparent material. If the number of the potential etch points exceeds a predetermined number, the system carries out an optimization routine that allows the number of the generated etch points to be reduced based on their size. To prevent the distortion of the reproduced image due to the refraction of the optically transparent material, the coordinates of the generated etch points are adjusted to correct their positions along a selected laser beam direction.

Russian patent publication RU 20082288 to S. V. Oshemkov discloses a process for laser forming of images in solid media by the way of focusing of laser radiation in a point inside a sample.

U.S. patent application Ser. No. 09/583,454 to Troitski discloses a method and system for producing etch points by control of breakdown process development.

From Patents mentioned above, it is possible to conclude that laser-induced damages used for creation of images are preferably produced by a Nd-YAG laser operating at a wavelength of 1064 nm. The energy density of each pulse is sufficient to induce localized ionization of the material at the focus of the beam. U.S. Pat. No. 5,637,244 is specially recommends to use a solid-state Q-switched laser. U.S. Pat. Nos. 5,206,496 and 5,575,936 recommend to use laser pulses with length of 10 nsec. Soviet Patent publication 1838163 and EPO Patent Document 0743128 disclose methods of induced-damage image production by using a repetition of laser pulses for creation of each pulse. All this performance requirements are found in many kinds of commercial Nd-YAG lasers. However, U.S. patent application Ser. No. 09/583,454 to Troitski discloses a method accordance to which for production of high quality laser-induced damage images, it is reasonable to create plasma (to produce breakdown) by a power laser pulse of short pulse duration and after to maintain the plasma by smaller power laser pulses of longer pulse width. For using the method, the more composite laser systems should be used. The usable laser systems are disclosed in following Patents: U.S. Pat. No. 4,630,275 to William R. Rapoport, U.S. Pat. No. 4,675,872 to Mare H. Popek et al., U.S. Pat. No. 4,959,838 to Norman P. Barnes et al., U.S. Pat. No. 5,001,716 to Bertram C. Johnson et al., U.S. Pat. No. 5,293,389 to Makoto Yano et al., U.S. Pat. No. 5,339,323 to John Hunter et al., U.S. Pat. No. 5,343,483 to Patrick V. Farrell et al., U.S. Pat. No. 5,363,387 to Edward L. Sinofsky, U.S. Pat. No. 5,640,412 to Edward D. Reed, U.S. Pat. No. 5,661,748 to Dov Zahavi et al., U.S. Pat. No. 5,675,596 to Hong-Jin Kong et al., U.S. Pat. No. 5,721,749 to Gerald W. Holleman et al., U.S. Pat. No. 5,832,013 to Michael J. Yessik, and U.S. Pat. No. 5,963,575 to Gerhard Muller et al.

All of the above disclosures are specifically incorporated by reference herein for enabling one of skill in the art to etch an image in a transparent material according to the one element of the present invention. However, none of the forgoing examples disclose a decorative article having an etched image which appears to follow the eye when viewed from different angles. Our invention satisfies these needs.

BRIEF SUMMARY OF THE INVENTION

It is therefore a principal object of the present invention to provide a decorative article having an etched image inside a transparent material which appears to follow the eye when viewed from different angles.

To overcome the problems of the prior art and in accordance with the purpose of the invention, as embodied and broadly described herein, briefly, a decorative article is provided having an optically transparent solid material, having top, bottom, front, back and side surfaces, an opaque material covering the back, side and top surfaces, and an image inside the transparent material defined by etch points having a convex exterior surface facing the back surface and a concave interior surface facing the front surface.

Additional advantages of the present invention will be set forth in part in the description that follows and in part will be obvious from that description or can be learned from practice or testing of the invention. The advantages of the invention can be learned from practice or testing of the invention. The advantages of the invention can be realized and obtained by the apparatus and methods particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the invention and, together with the description, explain the principles of the invention.

DETAILED DESCRIPTION OF THE DRAWINGS

Unless specifically defined otherwise, all technical or scientific terms used herein have the same meaning as commonly understood by one of ordinary skill in the art to which this invention belongs.

Although any methods and materials similar or equivalent to those described herein can be used in the practice or testing of the present invention, the preferred methods and materials are now described. Reference now will be made in detail to the presently preferred embodiments of the invention, examples of which are illustrated in the accompanying drawings.

The laser etched image may be created by one or more of the above referenced disclosures. However, in a preferred embodiment, a three dimensional sub-surface laser etched portrait image is a 180 degree scan from ear to ear created from imported three dimensional data generated from a three dimensional laser digitizer, such as the Vivid 300 from Minolta Corporation. The data is then input into a three dimensional rendering program where the information is decimated into a point cloud, based on color, and reformatted as a computer aided design file (CAD). The CAD file is then downloaded into a scientific computer that controls a three dimensional Y.A.G. laser, of any kind well known in the art. The laser may be either a red beam having a frequency of 1064 or a green beam having a doubled frequency of 532. The green beam creates fractures a half the size and twice the density of the red beam which results in a higher resolution. The Y.A.G. laser uses focal depth to etch the center of the glass without disturbing the surface. The etch is created as the laser, following the points in the CAD file, creates thousands of tiny micro fractures in the glass. Because of the nature of this process, the glass to be etched is desirably optically perfect, preferably grade k-9 of better, to prevent it from shattering. Typical lasers usually etch at a speed of 1000 HZ or 1000 points per second.

Figure 1:
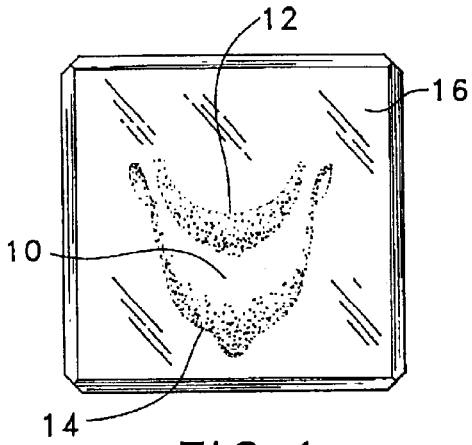
FIG. 1 is a top view of a portrait image etched in the transparent material.

Referring now the drawing figures, wherein like number represent like features, FIG. 1, illustrates a top view of, for example, a portrait image 10 laser etched inside the transparent material 16. To achieve the apparent motion of the image when viewed from different angles the portrait is etched such that a convex exterior surface 14, including the forehead, face, neck and ears, is generated around a concave interior surface 12.

Figure 2:
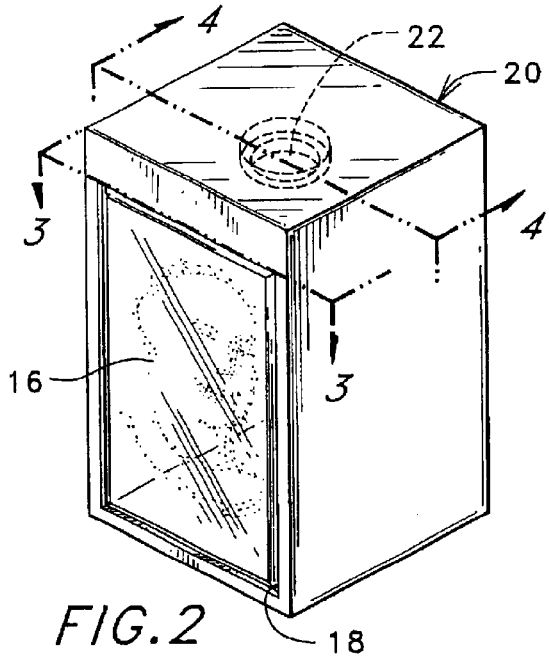
FIG. 2 is a isometric view of the transparent material contained in the opaque covering.

FIG. 2 is a isometric view of the transparent material contained in the opaque covering. The opaque covering may be made of any opaque material such as a paint, plastic, wood, metal or sand blasting and may, but need not, include a reflective layer (not shown) between the opaque covering and the transparent material. The opaque covering is preferably a box like structure 20 housing the transparent material 16 with an opening 18 in the front for viewing the portrait image 10. The box may also, but need not, include an opening 22 in the top wall for receiving an illumination means, such a an led lamp, which ultimately enhances the brightness of the portrait image.

Figure 3:
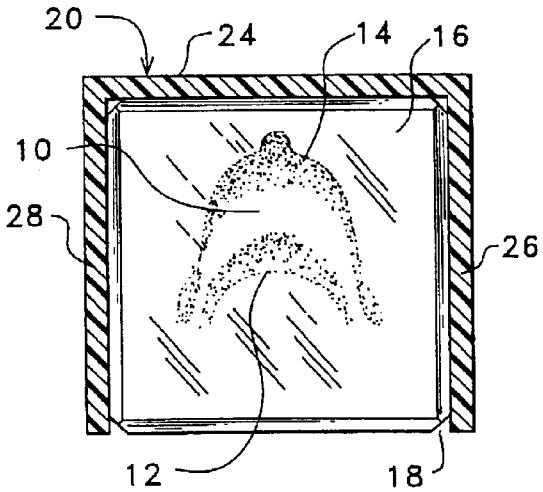
FIG. 3 is a sectional view along section 3 of FIG. 2 showing the position of the convex exterior region of the etched image in relation to the opaque walls.

Referring now to FIG. 3, a sectional view is shown along section 3 of FIG. 2 which illustrates the necessary direction of the convex exterior 14 portion of the etched image 10 in relation to the rear 24 and side walls 26, 28 of the box 20. In this manner, the convex exterior 14 portion, or nose and face, of the etched portrait image 10 faces toward the rear wall 24 and concave interior 12 portion of the etched image 10 faces the opening 18 in box 20 for viewing.

Figure 4:
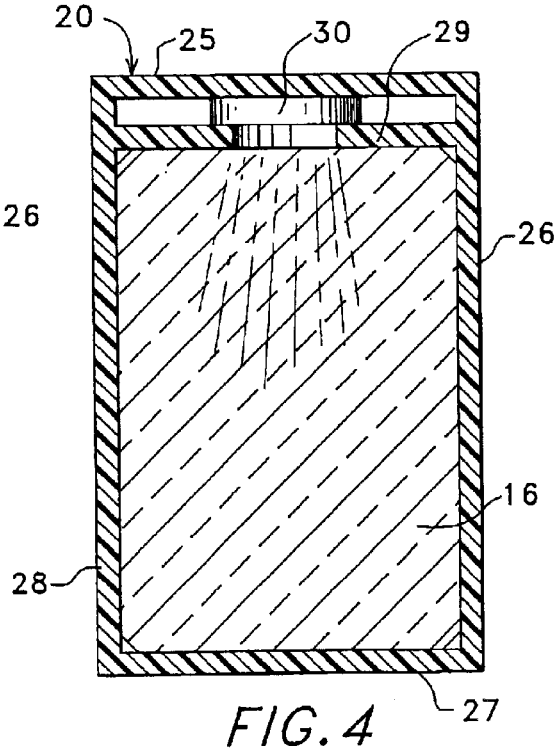
FIG. 4 is a sectional view along section 4 of FIG. 2 showing a preferred embodiment for illumination of the transparent material.

Turning now to FIG. 4 where it is shown a sectional view along section 4 of FIG. 2 a preferred embodiment of the present invention is illustrated to include a light 30 which penetrates an inner top wall 29 of box 20 for illumination of the transparent material 16. An outer top wall 25 may be included as a housing for the light 30.

Figure 5:
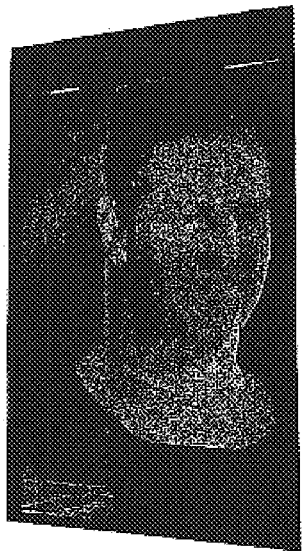
FIG. 5 is a photograph of the decorative article when viewed from the right.
Figure 6:
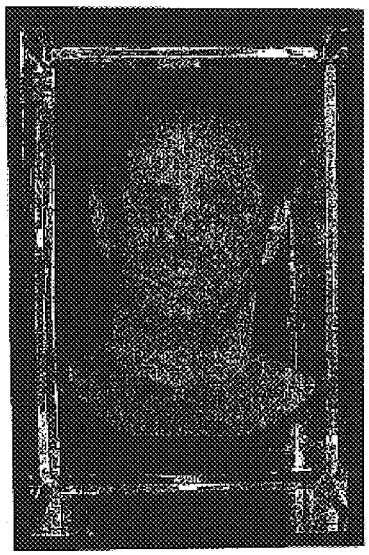
FIG. 6 is a photograph of the decorative article when viewed from the center.
Figure 7:
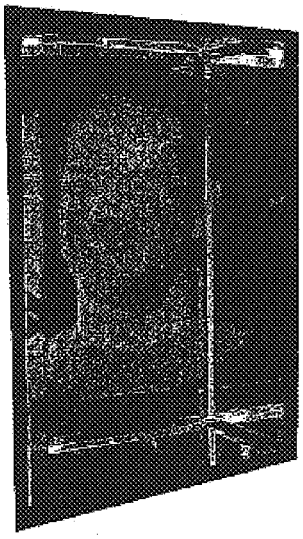
FIG. 7 is a photograph of the decorative article when viewed from the left.
Figure 8:
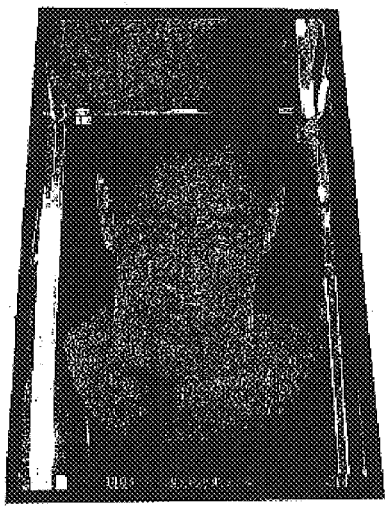
FIG. 8 is a photograph of the decorative article when viewed from above.
Figure 9:
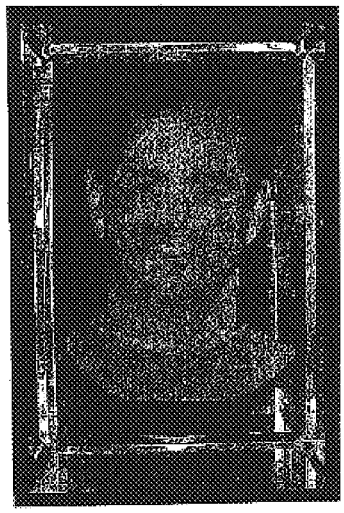
FIG. 9 is a photograph of the decorative article when viewed from the center.
Figure 10:
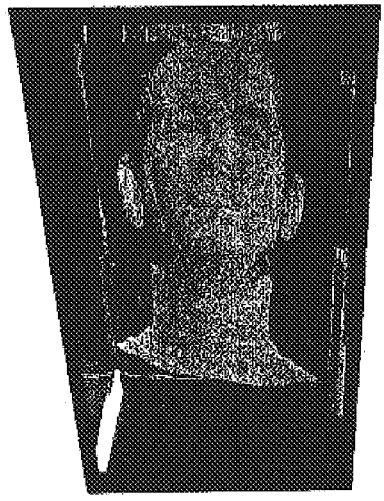
FIG. 10 is a photograph of the decorative article when viewed from below.

When etched and assembled in the above manner the portrait image appears to move, or follow the eye, within the transparent material 16 when viewed at different angles relative to the opening 18. To illustrate this effect, FIGS. 5, 6, and 7 show how the image appears to be looking in different directions when viewed right, center and left, respectively, in relation to the opening 18. FIGS. 8, 9, and 10 show how the image appears to be looking in different directions when viewed from above, even and below, respectively, in relation to the opening 18. It is this effect which enhances the desirability of the decorative article in accordance with the present invention.

While the present invention has been described in connection with the illustrated embodiments, it will be appreciated and understood that modifications may be made without departing from the true spirit and scope of the invention. For example, it is intended herein that images such as a design or logo are within the scope of the present invention.

I claim:

1. A decorative article, comprising:

(a) an optically transparent solid material, having top, bottom, front, back and side surfaces;

(b) an opaque means covering the back, side and top surfaces; and (c) an image inside the transparent material, defined by etch points, having a convex exterior surface facing the back surface and a concave interior surface facing the front surface.

2. The decorative article according to claim 1 further including a means for illumination.

3. The decorative article according to claim 2 wherein the illumination means is a light projecting through the top wall of the opaque covering means to an interior of the transparent material.

4. The decorative article according to claim 1 wherein the opaque covering means is a box for housing the back, side and top surfaces.

5. The decorative article according to claim 1 further comprising a reflective layer between the opaque covering means and the optically transparent material.

6. The decorative article according to claim 1 wherein the image is a portrait.

7. The decorative article according to claim 1 wherein the image is a design.

8. The decorative article according to claim 1 wherein the image is a logo.

* * * * *